United States Patent [19]

Taniguchi et al.

[11] Patent Number: 4,834,549

[45] Date of Patent: May 30, 1989

[54] MIXING MACHINE

[75] Inventors: Toru Taniguchi, Kobe; Yozo Yamada, Yamatotakada; Tatsuo Utsumi, Takatsuki, all of Japan

[73] Assignee: Tokushu Kika Kogyo Kabushiki Kaisha, Osaka, Japan

[21] Appl. No.: 160,862

[22] Filed: Feb. 26, 1988

[30] Foreign Application Priority Data

Feb. 27, 1987 [JP] Japan ..... 62-42834

[51] Int. Cl.[4] ..... B01F 7/16

[52] U.S. Cl. ..... 366/286; 366/205; 366/314

[58] Field of Search ..... 366/286, 190, 194, 195, 366/196, 205, 314, 279, 262, 263, 264

[56] References Cited

U.S. PATENT DOCUMENTS 2,157,683 5/1939 Vollrath ..... 366/286

2,159,670 5/1939 Neitzke ..... 366/286

*Primary Examiner*—Robert W. Jenkins

*Attorney, Agent, or Firm*—Michael N. Meller

[57] ABSTRACT

A mixing machine has a rotor which can be displaced along an axis. The rotor and its drive shaft are rotatably supported by a casing and a cylindrical shaft respectively. A motor for driving the rotor is mounted on a support connected to the end of the cylindrical shaft. The cylindrical shaft can be displaced along the axis. At the lowermost position, holes in a plate of the casing communicate with a discharge port in the structure supporting the cylindrical shaft, whereby rotation of the rotor forces the tank contents out the discharge port.

5 Claims, 3 Drawing Sheets

MIXING MACHINE

FIELD OF THE INVENTION

The invention relates to a mixing machine for mixing powdered particles in liquid or emulsion to produce emulsified products such as chemical products, food products, medicines or cosmetics.

BACKGROUND OF THE INVENTION

In conventional mixing machines of this type, the rotor and the casing are generally attached to the lower end of a rotating shaft, which is inserted into the mixing tank from the top, and the rotor in the casing is held at an intermediate position in the tank and driven for mixing operation.

In the aforementioned conventional mixing means, the rotor in the casing is driven at a fixed intermediate position in the tank, so that it is not possible to appropriately adapt the mixing operation to a change in the volume of the contents in the tank to be processed. Especially when a large difference between the volume of the tank contents in the initial stage and a subsequent stage of the mixing process arises, it is not possible with the conventional mixers to provide an optimum mixing operation adapted for the particular volume of the contents at each stage. This inevitably results in uneven quality of the product and also a longer processing time. Further, when the powdered material is fed from the top of the tank into the liquid contents therein, it is desired that the mixing operation be performed near the liquid surface because the powdered material tends to float there. However, the conventional mixing equipment is unable to generate agitations that approach the liquid surface to provide an effective mixing operation. In addition, particles of some powdered materials tend to settle on the bottom of the tank due to gravity, in which case the conventional mixing equipment often fails to generate agitations effective enough to disperse the settled particles. Also when liquid contents with different specific gravities are to be mixed, the upper and lower parts in the tank are not uniformly mixed so that uniform emulsion cannot be obtained.

BRIEF SUMMARY OF THE INVENTION

This invention eliminates the disadvantages of conventional mixing machines and makes it possible to perform the mixing operation in dependence on the change in the mixing conditions in the tank so as to attain improved efficiency in the mixing process. The invention is characterized by a construction wherein a cylindrical shaft is passed vertically into the mixing tank through the tank bottom; a rotating shaft is inserted in the cylindrical shaft along the central axis; a rotor coupled to the upper end of the rotating shaft is disposed within a casing which is coupled to the upper end of the cylindrical shaft; and a drive mechanism installed outside the tank drives the cylindrical shaft and the rotating shaft to move up or down in the vertical direction.

Since the rotor and casing for the mixing operation are coupled respectively to the upper ends of the cylindrical shaft and the rotating shaft, the cylindrical shaft being inserted into the tank from the bottom and the rotating shaft extending through the axis of the cylindrical shaft, and since the cylindrical shaft and the rotating shaft are vertically movable, the positions of the rotor and casing in the tank can be freely changed to adapt to the changing condition of mixing in the tank. With this arrangement, it is possible to position the rotor and the casing at the optimum positions in response to the process condition in the tank. Namely, at the initial stage of the mixing process when the material has just been introduced into the tank, the rotor and casing are lowered to respective lower positions to perform the mixing operation. As liquid materials are added to dilute the contents in the tank and thus increase the volume thereof, the rotor and casing are moved to upper positions to perform the mixing operation. When powdered material is added to the liquid contents in the tank the rotor and casing are operated at the upper positions to effectively agitate and uniformly disperse the material particles in the liquid contents. When the powdered material tends to settle on the tank bottom, the rotor and casing are positioned close to the bottom to perform the mixing operation. If necessary, it is also possible to continuously move the rotor and casing up and down while turning the rotor to mix the upper and lower portions of the contents in the tank uniformly and thoroughly The rotor and the casing can also be lowered to a position below the bottom of the tank, as shown in FIG. 5, and the discharge port is formed to open under the casing in the lowered position. This arrangement allows the processed contents to be drawn out through the discharge port by the downward pressure of the rotating rotor, thus eliminating a suction pump, which is required in the conventional mixing machine for drawing out the processed contents.

BRIEF DESCRIPTION OF THE DRAWINGS

The preferred embodiment in accordance with the invention will be described in detail with reference to the attached drawings, wherein.

DETAILED DESCRIPTION OF THE PREFERRED EMBODIMENTS

Figure 1:
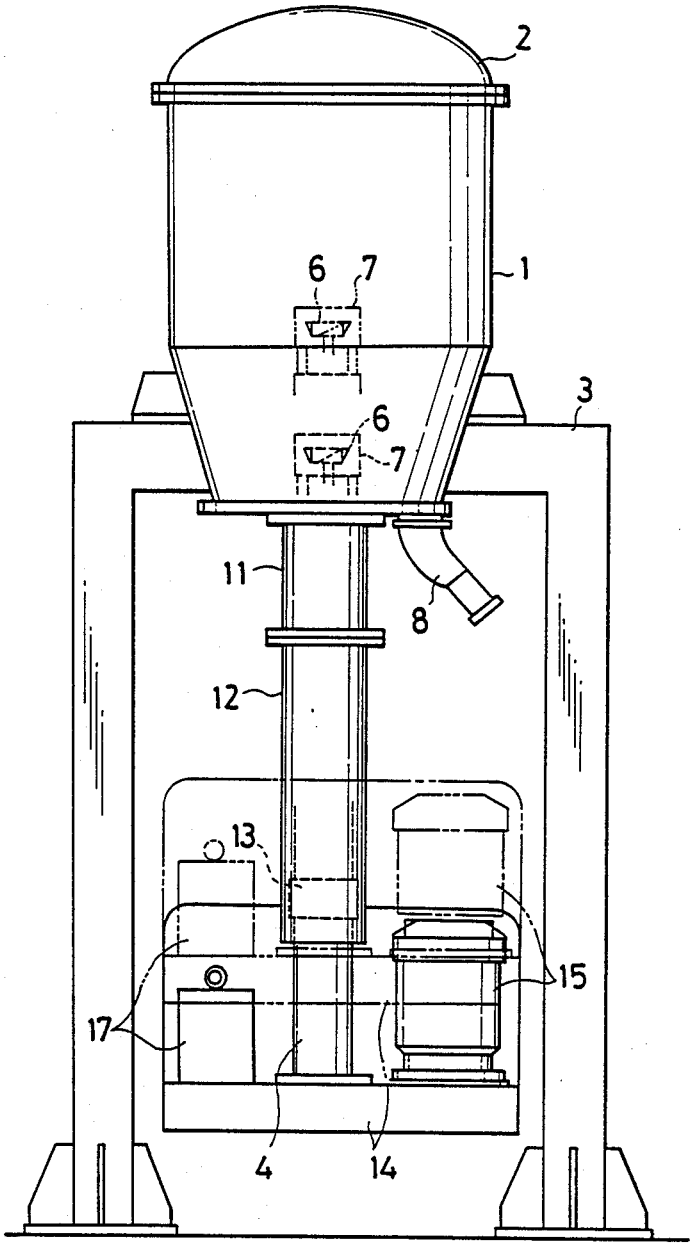
FIG. 1 is a side view of the preferred embodiment of the mixing machine in accordance with the invention.

In the drawings, reference numeral 1 denotes a mixing tank with a cover 2 at the top. The mixing tank 1 is fixedly mounted on a machine base 3.

Figure 2:
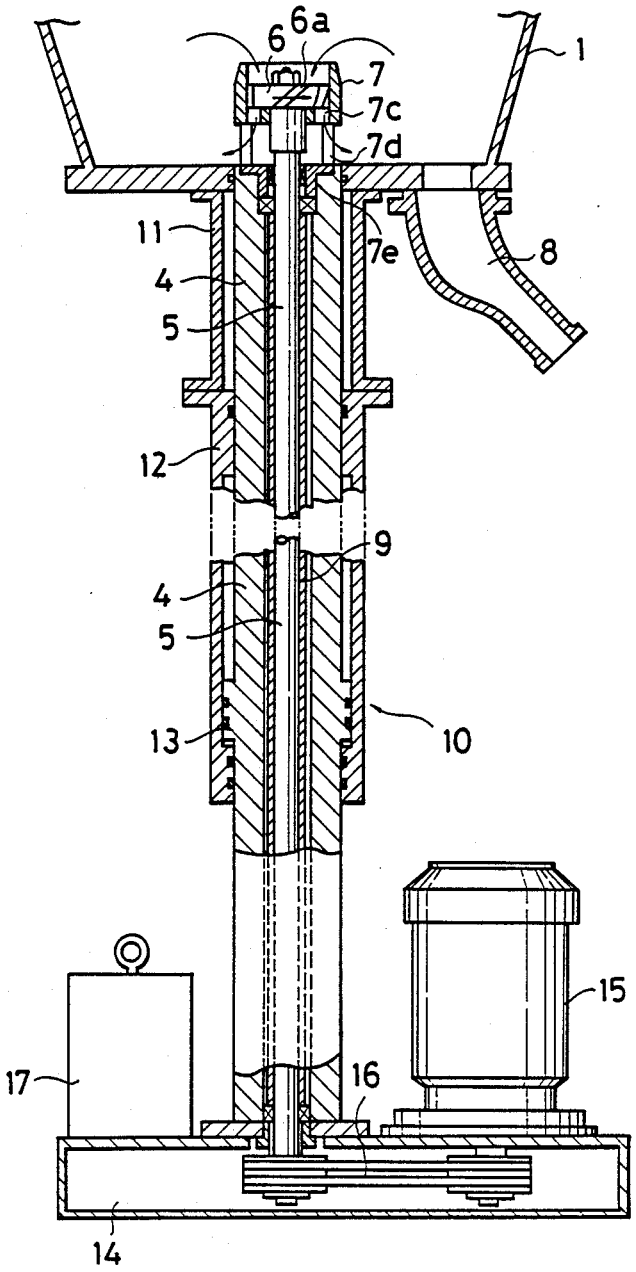
FIG. 2 is a sectional side view of essential parts of the preferred embodiment.

Reference numeral 4 denotes a hollow cylindrical shaft passing vertically through the bottom of the mixing tank 1. As shown in FIG. 2, extending through the cylindrical shaft 4 and coaxial therewith is a rotating shaft 5, which is coupled at its upper end with a rotor 6 in the tank 1. The rotor 6 (see FIG. 3) has inclined vanes **6*a* along its circumference and is placed within a cylindrical casing 7 (see FIG. 4) joined to the upper end of the cylindrical shaft 4**.

Figure 4:
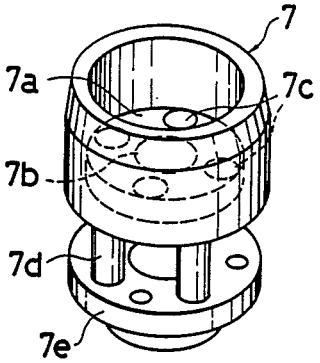
FIG. 4 is a perspective view of the casing.

The casing 7, as shown in FIG. 4, has a bottom plate **7*a* with a hole 7*b* at the center through which the rotating shaft 5 is loosely inserted. The bottom plate 7*a* also has through openings 7*c* distributed around the center hole 7*b*. Provided under the bottom plate 7*a* are connecting rods 7*d* through which a coupling piece 7*e* is integrally connected to the bottom plate 7*a* with a space therebetween. The casing 7 is integrally jointed to the upper end of the hollow cylindrical shaft 4** through the coupling piece *7e*.

Reference numeral 8 (see FIGS. 1 and 5) denotes a discharge port for the emulsified products. Though not shown, the discharge port is provided with a valve device which is opened at an appropriate time. Reference numeral 9 denotes a sleeve fitted over the rotating shaft 5.

The cylindrical shaft 4, vertically passing through the bottom of the tank 1 and having the coaxial rotating shaft 5 contained therein, and further having the casing 7 containing the rotor 6 positioned in the tank 1, is arranged to be vertically displaced by a drive mechanism 10 provided outside the tank 1.

Figures 6A, 6B, 6C:
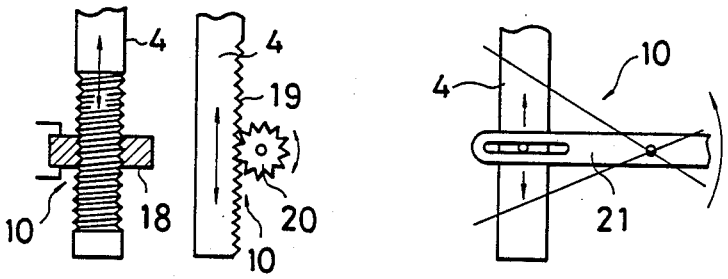
FIG. 6A, 6B, and 6C are side views of the respective alternative drive mechanisms for the cylindrical shaft.

Various kinds of drive mechanism 10 are possible. They may include, for example, (a) an air or hydraulic cylinder as shown in FIG. 2; (b) a nut sleeve 18 so fitted as to be immovable in the vertical direction and threadedly engaging a threaded portion of the cylindrical shaft 4 so that the cylindrical shaft is displaced vertically only when the nut sleeve 18 is rotated as shown in FIG. 6A; (c) a pinion 20 engaging a rack 19 formed on the cylindrical shaft 4, the pinion 20 being rotated to displace the cylindrical shaft 4 up or down as shown in FIG. 6B; or (d) an oscillating link 21 engaging the cylindrical shaft 4, the oscillating link being oscillated to displace the cylindrical shaft 4 up or down as shown in FIG. 6C.

In the drive mechanism using the hydraulic cylinder, a connecting cylinder 11 is securely mounted to the underside of the mixing tank 1, as shown in FIG. 2. A cylinder 12 whose upper and lower ends are hermetically sealed is connected to the lower end of the connecting cylinder 11. Inside the cylinder 12 is inserted a cylindrical shaft 4 which has a bulging portion 13 that serves the function of a piston. The cylinder 12 has first and second bores of first diameter at each end thereof for receiving the portions of cylindrical shaft 4 other than the bulging portion 13 and a third bore of second diameter, communicating with the first and second bores, for receiving the bulging portion 13. The height of the third bore is greater than the height of the bulging portion 13. The bulging portion 13 is displaced up or down by supplying hydraulic pressure into the cylinder 12 (the hydraulic pressure supply system is not shown). The vertical displacement of the bulging portion 13 causes the rotor 6 and the casing 7, with their relative positions maintained, to displace up and down within the tank 1 or, when necessary, to continually repeat the vertical shuttle displacement.

Figure 3:
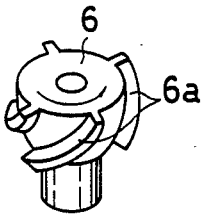
FIG. 3 is a perspective view of the rotor.

A support frame 14 is connected to the lower end of the cylindrical shaft 4 projecting downwardly from the drive mechanism 10 which employs the cylinder 12. A motor 15 installed on the support frame 14 drives the rotating shaft 5 through a belt transmission mechanism 16 or gear transmission mechanism. This in turn rotates the rotor 6 in the direction of an arrow, as shown in FIG. 3, in the casing 7 to draw the contents in the tank 1 from the upper surface of the casing 7 to the interior of the casing 7. The contents are then pressurized by the inclined vanes *6a* and forced downwardly through the openings *7c* of the casing 7, as indicated by arrows in FIG. 2. In this process, the contents in the tank are mixed and emulsified and the processed products are discharged through the discharge port 8 when the valve is opened.

Reference numeral 17 denotes a balance weight placed on the support frame 14 at the side opposite to the motor 15 to ensure smooth and crisp vertical displacement of the cylindrical shaft 4. As mentioned above, in the mixing process for emulsification, the vertical positions of the rotor 6 and the casing 7 are freely and appropriately changed according to the condition of the tank contents to be processed by vertically displacing the cylindrical shaft 4 by the drive mechanism 10 which uses the cylinder 12, while the rotating shaft 5 is being rotated, so that the mixing operation is carried out more efficiently.

Figure 5:
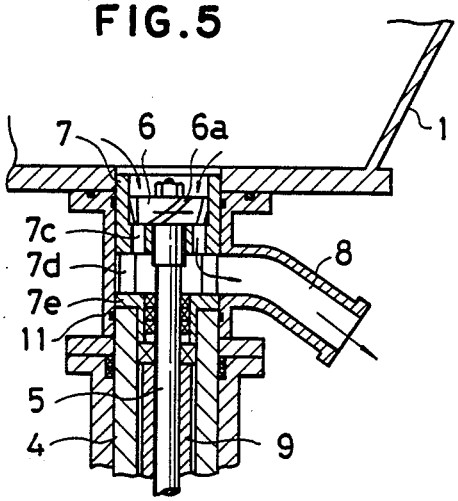
FIG. 5 is a partial section side view of another preferred embodiment of the invention.

In FIG. 5, the lowered positions of the rotor 6 and casing 7 are below the bottom of the tank 1, that is, rotor 6 and casing 7 are lowered to be within the connecting cylinder 11 which is securely attached to the underside of the tank 1. The discharge port 8 is provided below these positions. In this case the products in the tank are forced toward the discharging port 8 by the downward pressure of the rotating rotor 6. This arrangement has the advantage of eliminating the pump facility used with the conventional mixing equipment for discharging the products.

The present invention offers the following advantages. Since the mixing rotor and coating which are inserted into the tank from the bottom are vertically displaceable, they can be positioned at an appropriate level in the tank in dependence on changes in the conditions of the contents to be processed, such as the amount of level of the contents and the viscosity thereof. In particular, when the rotor and casing are placed close to the bottom of the tank, an effective mixing is obtained by the downward pressure of the rotor working against the tank bottom. This is very effective in mixing powdered particles that tend to settle in the liquid contents and also in processing a small amount of contents in the tank. This mode of operation generally improves the quality of the products and reduces the processing time. Furthermore, since the rotor and the casing are inserted into the tank from the tank bottom, there is no working shaft or other mechanism above the upper side of the rotor and casing. This enables the contents to smoothly flow into the mixing rotor section without obstruction.

What is claimed is:

1. A mixing machine comprising:

a mixing tank; a hollow cylindrical shaft passing vertically through the bottom of the mixing tank; a rotating shaft inserted in the cylindrical shaft along the central axis; a rotor coupled to the upper end of the rotating shaft; a casing coupled to the upper end of the cylindrical shaft, the casing containing the rotor; and a drive mechanism installed outside the mixing tank for vertically moving the cylindrical shaft and the rotating shaft.

2. A mixing machine as set forth in claim 1, wherein the rotor and the casing are positioned below the bottom of the mixing tank by lowering the cylindrical shaft and the rotating shaft and a discharge port is provided below the lowered position of the cylindrical shaft and the rotating shaft.

3. A mixing machine comprising:

a mixing tank having a bottom with a hole therethrough;

means for mixing the contents of said mixing tank;

first drive means for rotating said mixing means; and means for supporting said mixing means whereby said mixing means can be displaced along an axis, wherein said first drive means comprises a motor, transmission means, and wherein said means for supporting said mixing means comprises a drive shaft coupled between said transmission means and said mixing means, means for rotatably supporting said drive shaft, means for supporting said motor, second drive means for displacing said means for rotatably supporting said drive shaft and said means for supporting said motor along said axis, and support means securely connected to said mixing tank for supporting said second drive means.

4. The mixing machine as defined in claim 3, wherein said means for rotatably supporting said drive shaft comprises a cylindrical shaft for receiving said drive shaft and a casing for rotatably supporting said mixing means.

5. The mixing machine as defined in claim 4, wherein said mixing means comprises a rotor, said rotor and said casing being displaceable to a discharge position below said bottom wall of said mixing tank and inside said support means, said support means have a discharge port formed therein, and said casing having a plate with a plurality of through holes, said through holes communicating with said discharge port when said casing is in said discharge position, whereby the contents of said tank are discharged through said discharge port during rotation of said rotor.

* * * * *